United States Patent [19]

Drapp

[11] Patent Number: 4,547,721

[45] **Date of Patent: * Oct. 15, 1985**

[54] TRANSFORMER STRUCTURE

[76] Inventor: Joseph W. Drapp, 7022 Eugene Ave., St. Louis, Mo. 63116

[ * ] Notice: The portion of the term of this patent subsequent to Sep. 4, 2001 has been disclaimed.

[21] Appl. No.: 620,039

[22] Filed: Jun. 13, 1984

Related U.S. Application Data

[62] Division of Ser. No. 211,756, Dec. 1, 1980, abandoned.

[51] Int. Cl.[4] ..... H01F 17/00

[52] U.S. Cl. ..... 323/355; 336/69; 336/147; 336/212

[58] Field of Search ..... 336/69, 145, 146, 147, 336/181, 184, 212, 213; 323/355

[56] References Cited

U.S. PATENT DOCUMENTS 4,470,006 9/1984 Drapp ..... 336/212

*Primary Examiner*—Peter S. Wong
*Assistant Examiner*—Anita M. Ault
*Attorney, Agent, or Firm*—Polster, Polster and Lucchesi

[57] ABSTRACT

A transformer structure is provided having three cores of laminated magnet material positioned to define two transformer winding carriers. In the preferred embodiment, each core is a pair of C-shaped sections arranged in mouth-to-mouth relationship so as to form pairs of legs joined by connecting portions. A first leg of the first core and a second leg of the second core delimit one of the transformer winding carriers. A third leg of the second core and a fourth leg of the third core delimit the other transformer winding carriers. The winding includes a primary transformer winding having at least a first coil and a second coil, and a secondary transformer winding having at least a first coil and a second coil. The first coils of the primary and second winding are wound along the first transformer winding carrier while the second coils of the primary and secondary transformer windings are wound along the second transformer winding carrier. The primary coils are wound in parallel in such a way that the AC voltage polarity in the two primary coils is 180° out of phase with respect to one another and the AC voltage polarity in the two secondary coils is 180° out of phase with respect to one another.

2 Claims, 7 Drawing Figures

TRANSFORMER STRUCTURE

This is a division of application Ser. No. 211,756, filed Dec. 1, 1980 now abandoned.

BACKGROUND OF THE INVENTION

This invention relates to dynamoelectric machines and in particular, to transformer construction and transformer winding.

The principal types of transformer constructions used in the past commonly are classified as core type transformers and shell type transformers. In the core type transformer, the transformer windings surround a laminated iron core. In the shell type transformer, the iron core surrounds the transformer windings. In either case, the transformer windings are arranged to define a primary winding and a secondary winding which are electrically insulated from each other by any suitable means.

While both the shell and core type transformer work well for their intended purposes, I have found that the transformer construction disclosed hereinafter offers superior electrical performance while effectuating a cost savings with respect to weight of material used in that transformer construction in comparison to the more conventional transformer arrangements discussed above. This is surprising in that initially it would appear that more laminated core material is required with the transformer of this invention. However, the performance to weight ratio of transformers employing the invention disclosed hereinafter is superior to electrically equivalent prior art transformers because a physically smaller transformer constructed in accordance to the principles of my invention performs equally as well as or better than its physically larger prior art equivalent.

The superior performance of the transformer of this invention is related to the fact that pairs of primary coils and pairs of secondary coils, connected in parallel, are wound to produce AC voltage polarity 180° out of phase in the coils of each pair.

One of the objects of this invention is to provide a low cost transformer construction.

Another object of this invention is to provide a transformer construction having improved performance characteristics.

Other objects of this invention will be apparent to those skilled in the art in light of the following description and accompanying drawings.

SUMMARY OF THE INVENTION

In accordance with this invention, generally stated, an improved transformer structure employs three cores of magnetic material, arranged so that a central core has another core positioned on two outboard sides of it. Each core has predetermined winding accommodating portions. Respective ones of two winding accommodating portions of the central core are juxtapositioned with one winding accommodating portion of each outboard core to define first and second transformer winding carriers. The transformer winding includes a primary winding having at least two coil sets and a secondary winding having at least two coil sets. One primary coil set and one secondary coil set is carried by respective ones of the transformer winding carriers. The primary coil sets are connected in parallel with one another across a source of electrical energy. The secondary coil sets also are connected in parallel across a suitable load. The coils of each pair of coil sets are wound and connected in such a way as to produce an AC voltage polarity that is 180° out of phase with respect to one another. In one embodiment, capacitor coils are electrically connected to and through a capacitor and to the primary coils.

DESCRIPTION OF THE PREFERRED EMBODIMENT

Figure 1:
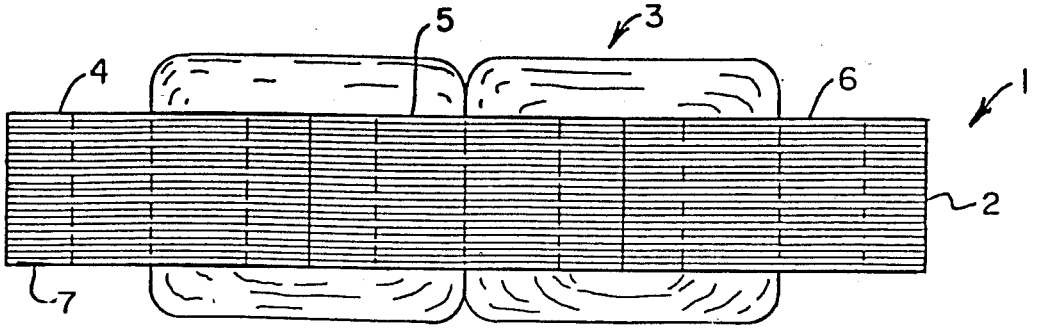
FIG. 1 is a top plan view of one illustrative embodiment of transformer of this invention.

Referring now to FIGS. 1-5, reference numeral 1 indicates one illustrative embodiment of transformer of this invention. Transformer 1 includes a core structure 2 and transformer windings 3.

The core structure 2 includes a plurality of transformer cores 4, 5 and 6, respectively. The cores 4, 5 and 6 are identical and each is assembled from a plurality of laminations 7 formed from suitable magnetic material. The laminations 7 are constructed by a conventional punch press operation. During that manufacture, they are punched, in the embodiment illustrated, with C-shaped silhouettes, best observed in FIG. 2. The C-shapes of the laminations 7 delimit a pair of leg sections 80 and 81, respectively, joined to one another by a connection part 82, the leg sections 80 and 81 being arranged so that each lamination defines a mouth 8.

The laminations 7 are joined to one another to form a core portion 85. The core portion 85 has some predetermined stack height, which may vary in embodiments of the invention. Interconnections of the laminations 7 may be accomplished in any convenient way. Epoxy adhesives, welding, and, preferably, mechanical interconnection such as by non-magnetic straps are commonly employed to join electrical laminations to one another to form the core portion 85. In the preferred embodiment shown, band wound Hipersil cores are employed. The C-shapes of the laminations 7 are positioned adjacent one another along their mouths 8 so that the leg sections 80 and 81 of respective pairs of laminations 7 forming the core portions 85 define, in their assembled position, legs 9 and 10 for the core 4, legs 11 and 12 for the core 5, and legs 13 and 14 for the core 6. Those skilled in the art will recognize that the individual cores of the core structure 2 may be formed in a number of ways.

Figure 2:
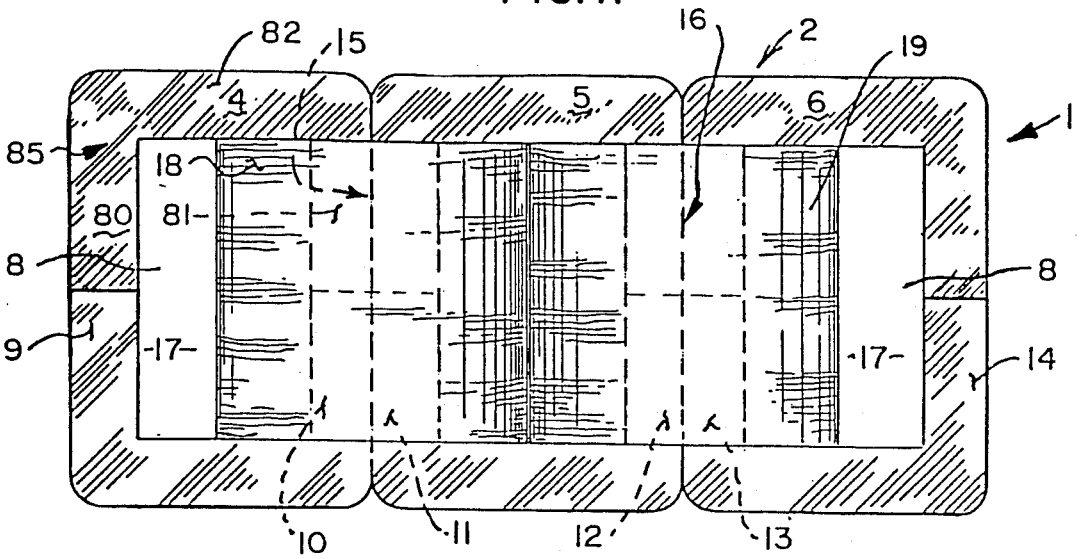
FIG. 2 is a front elevational view of the transformer shown in FIG. 1.
Figure 3:
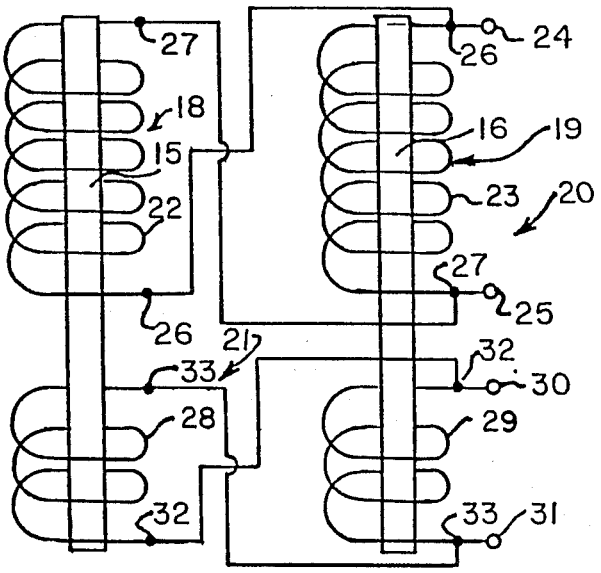
FIG. 3 is a diagrammatic view of the transformer windings employed with the transformer shown in FIG. 1.
Figure 4:
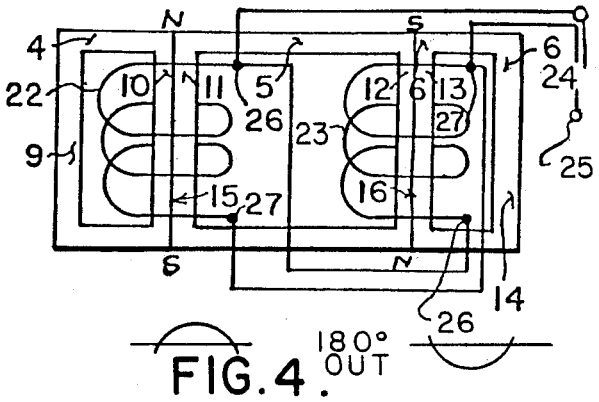
FIGS. 4 and 5 are still other diagrammatic views of the transformer windings employed, with the phase differences in two primary coils indicated.
Figure 5:
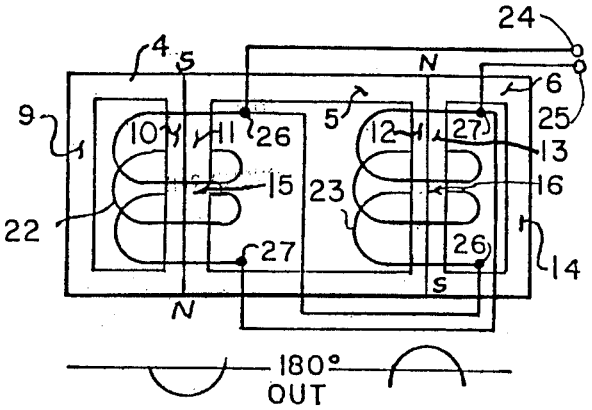

As shown in FIG. 2, the core 5 is the central core of the core structure 2, the cores 4 and 6 being positioned outboard and generally adjacent the core 5 so that the leg 10 of the core 4 and the leg 11 of the core 5 delimit a transformer winding carrier 15 while the leg 12 of the core 5 and the leg 13 of the core 6 delimit a second transformer winding carrier 16. The cores 4, 5 and 6 have central openings 17 through them, which permit accommodation of the transformer winding 3 along the transformer winding carriers 15 and 16. A coil structure 18 of transformer winding 3 is carried along the transformer winding carrier 15 while a coil structure 19 of transformer winding 3 is carried along the transformer winding carrier 16.

Transformer winding 3 of the embodiment shown in FIGS. 1–5 includes a primary winding 20 and a secondary winding 21. The term primary is used in its conventional sense in that the primary winding is intended to be connected across a suitable source of electrical energy, while the secondary winding delivers it to a load across which it is electrically connected. Those skilled in the art will recognize that when the transformer is used to step up the voltage, the low voltage winding is the primary. Conversely, when a transformer is used to step down the voltage, the high voltage winding is the primary. That is to say, the primary is always connected to the source of electrical energy and the secondary is always connected to a load, although the windings may function as either primary or secondary windings depending upon their applicational use.

The primary winding 20 includes a first coil set 22 and a second coil set 23 connected in parallel to one another at connection points 26 and 27 in such a way that the voltage polarity in the coil set 22 is 180° out of phase from that in coil set 23. This is shown particularly in FIGS. 4 and 5. The coil sets 22 and 23 are connected to a source of electrical energy by a pair of lead conductors 24 and 25, the individual conductors 24 and 25 also being electrically connected to the points 26 and 27, respectively.

The secondary winding 21 includes a coil set 28 and a coil set 29 connected in parallel to one another at connection points 32 and 33. The voltage polarity in the coil set 28 is also 180° out of phase with respect to that in the coil set 29. The coil sets 28 and 29 are connected to any suitable load by output conductors 30 and 31, individual ones of which also are electrically connected to the points 32 and 33, respectively. The primary winding coil set 22 and the secondary winding coil set 28 together define the coil structure 18 of transformer winding 3 carried by the transformer winding carrier 15 of the core structure 2. The primary winding coil set 23 and the secondary winding coil set 29 together define the coil structure 19 of transformer winding 3 carried by the transformer winding carrier 16 of the core structure 2. The coil structures 18 and 19 are mounted on their respective transformer winding carrier in a conventional manner.

It thus may be observed that the transformer 1 of this invention is constructed in a manner substantially different from transformers of the prior art. While specific electrical characteristics of the transformer winding 3 vary with application, in spite of the phase difference in the coil sets, the transformer winding 3 is still designed with conventional turns ratio techniques to obtain the desired input and output voltage relationships. However, the construction and winding disclosed provides higher transformer ratings with physically smaller sizes than permissible with prior art transformer construction techniques. Transformer operation in applicational use is similar to prior art devices.

Merely by way of example, in the illustrative embodiment just described, the cores can be MA-907 Hipersil with a core area of 18 $cm^2$ and a core weight of 15.5 lbs., the primary coils can each have 167 turns of 12 AWG wire, and the secondary coils, 18 turns of 4 AWG wire. 120 volts 60 hz current applied to the primary will produce approximately 13 volts at the output side of the secondary.

Figure 6:
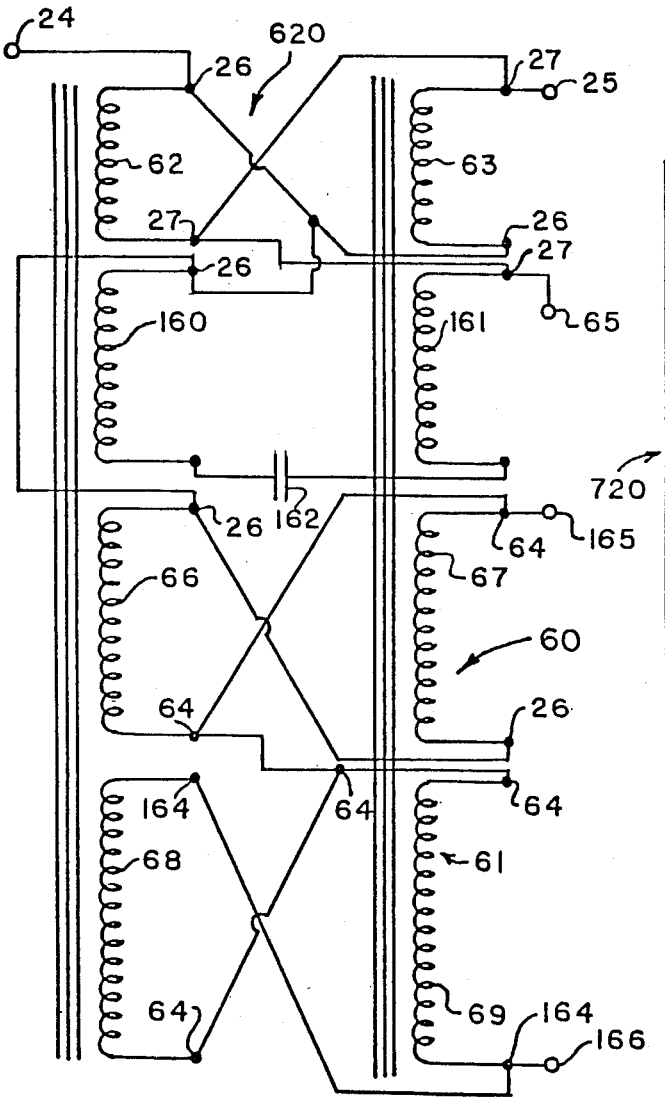
FIG. 6 is a diagrammatic view of another embodiment of transformer winding of this invention, with capacitor coils, auto connected.

Referring now to FIG. 6 for another embodiment of this invention, primary coil sets 62 and 63, making up a primary winding 620, are, like the coil sets 22 and 23 of the embodiment shown in FIGS. 1–5, electrically connected in parallel with one another and wound to produce AC voltage polarity 180° out of phase in the two coils. The primary coils 62 and 63 are electrically connected to common, neutral or ground 65, to a pair of secondary coil sets 66 and 67 making up a first secondary 60, and to capacitor coils 160 and 161. The capacitor coils 160 and 161 are electrically connected in a voltage add mode for each individual coil to the primary coils, and in series to one another through a capacitor 162. The capacitor coil 161 is electrically connected to common 65.

The secondary coil sets 66 and 67 are electrically connected through a tap 64 to a terminal 165 and, in series, to secondary coil sets 68 and 69. The coil sets 68 and 69 are electrically connected in parallel to one another, and, through a tap 164, to a terminal 166.

In this embodiment, merely by way of example, each primary coil set can have 23 turns, each of the coil sets of secondary 60, 70 turns, and each of the coil sets of the secondary 61, 88 turns, whereby an input of 30 volts to the primary will produce 120 volts at terminal 165 and 235 volts at terminal 166. Each of the capacitor coils 62 and 63 can have 60 turns, producing 186 volts across the capacitor 162, which can be a 2.5 mfd paper capacitor. The core area in this embodiment is 32.65 $cm^2$.

Figure 7:
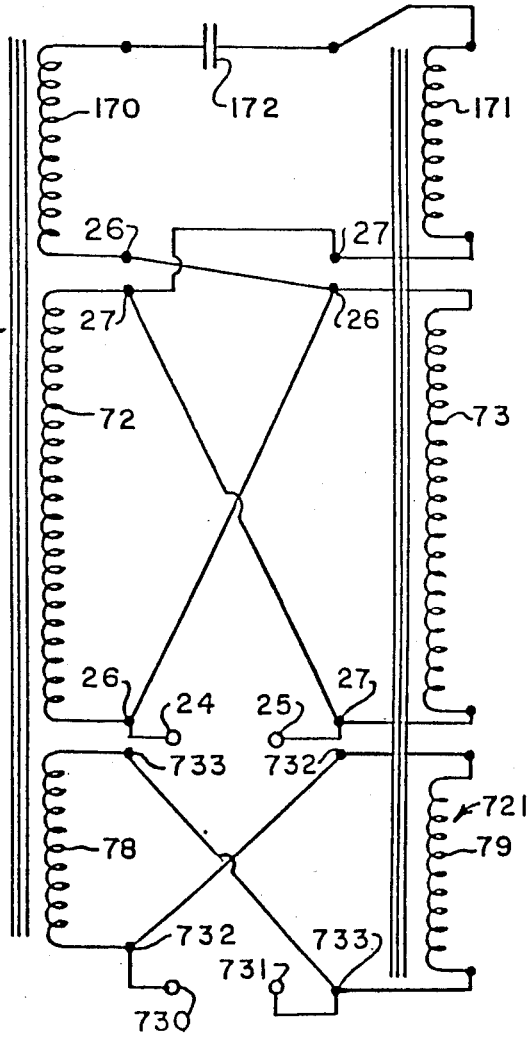
FIG. 7 is a diagrammatic view of still another embodiment of transformer winding of this invention, with capacitor coils, the secondary coils being inductively connected.

Referring now to FIG. 7, primary coil sets 72 and 73, making up a primary winding 720, are electrically connected in parallel to one another and in voltage add mode for each individual coil to capacitor coils 170 and 171. The capacitor coils 170 and 171 are connected in series with one another through a capacitor 172. In this embodiment, secondary coil sets 78 and 79, making up a secondary winding 721, are coupled inductively to the primary coils 72 and 73, but are not connected directly electrically. The secondary coil sets 78 and 79 are connected in parallel with one another and, through taps 732 and 733 respectively, to load terminals 730 and 731.

Merely by way of illustration, the primary coil sets 72 and 73 can each have 215 turns of No. 17 AWG copper wire, the capacitor coils 170 and 171, 56 turns of No. 19 AWG copper wire, and the secondary coil sets 78 and 79, 20 turns of No. 8 AWG copper wire. The capacitor 172 can have a capacitance of 2.65 mfd. 120 volt 60 hz current applied to the primary will produce 11.5 volts at the terminals 730 and 731, and 182 volts across the capacitor 172. The core area can be 14 $cm^2$.

In all of the illustrative examples, the winding turns were determined not only by voltage but by the number of magnetic lines of force per square centimeter of core material used.

It has been found that the provision of the capacitor in the circuits of the embodiment shown in FIGS. 6 and 7 improves the efficiency of the transformer, reducing the idling current markedly.

In all of the embodiments, the primary and secondary coil sets are wound in pairs and so connected as to produce the 180° out of phase AC voltage polarity described in detail in connection with the first embodiment.

Numerous variations within the scope of the appended claims will be apparent to those skilled in the art in light of the foregoing description and accompanying drawings. Thus, design silhouette of the individual cores 4, 5 and 6 of the core structure 2 may vary in other embodiments of this invention. Although the individual cores were described as two joined C-shaped sections, other sectional shapes or core configurations are compatible with the broader aspects of this invention. Although not shown or described, those skilled in the art will appreciate that suitable insulation is provided between the various windings and core structure. A number of insulating materials are available commercially for that purpose. These variations are merely illustrative.

I claim:

1. A transformer, comprising:

a first core of magnetic material having spaced first and second legs and connecting portions therebetween;

a second core of magnetic material having third and fourth legs and connecting portions therebetween, the second leg of said first core being positioned near the third leg of said second core to form a first transformer winding carrier;

a third core of magnetic material having fifth and sixth legs and a connecting portion therebetween, the fifth leg of said third core being positioned near the fourth leg of said second core to form a second transformer winding carrier;

a transformer winding including a primary winding having at least a first primary coil and a second primary coil connected in parallel and having input leads for connecting said primary winding to a source of electrical energy; and a secondary winding having at least a first secondary coil and a second secondary coil connected in parallel and having output leads for connecting said secondary winding to a load, said first primary coil and said first secondary coil being wound about said first transformer winding carrier, said second primary coil and said second secondary coil being wound about said second transformer winding carrier, said first and second primary coils being connected to produce an AC voltage polarity 180° out of phase in one another, and said first and second secondary coil being connected to produce an AC voltage polarity 180° out of phase in one another; and a pair of capacitor coils electrically connected, in voltage add mode for each individual capacitor coil, to the primary coils and electrically connected in series to one another through a capacitor.

2. A wound transformer comprising a plurality of cores having winding accomodating leg portions defining with legs of other of said cores first and second transformer winding carriers, a primary with two coil sets, identical in number of turns and size of wire, one on said first winding carrier, the other, on said second winding carrier, a secondary with two coil sets, identical in numbers of turns and size of wire, one on said first winding carrier, the other, on said second winding carrier, said primary coil sets being connected in parallel to produce a phase difference of substantially 180° in AC voltage polarity between said primary coil sets and said secondary coil sets being connected in parallel to produce a phase difference of substantially 180° in AC voltage polarity between said secondary coil sets, and a pair of capacitor coils electrically connected, in voltage add mode for each individual capacitor coil, to the primary coils and electrically connected in series to one another through a capacitor.

* * * * *